United States Patent [19]

Black

[11] Patent Number: 4,483,281

[45] Date of Patent: Nov. 20, 1984

[54] POPPET VALVE SPRING RETAINER WITH INTEGRAL HYDRAULIC TAPPET

[76] Inventor: Alfred A. Black, 126 Beaver St., Framingham, Mass. 01701

[21] Appl. No.: 507,909

[22] Filed: Jun. 27, 1983

Related U.S. Application Data

[60] Continuation of Ser. No. 356,782, Mar. 10, 1982, abandoned, which is a division of Ser. No. 55,951, Jul. 9, 1979, Pat. No. 4,321,894.

[51] Int. Cl.[3] ..... F01L 1/24

[52] U.S. Cl. ..... 123/90.55; 123/90.67

[58] Field of Search ..... 123/90.52, 90.53, 90.54, 123/90.55, 90.56, 90.57, 90.58, 90.59, 90.65, 90.67, 188 SC

[56] References Cited

U.S. PATENT DOCUMENTS

| | | | |
|---|---|---|---|
| 2,908,260 | 10/1959 | Bergmann | 123/90.55 |
| 3,301,239 | 1/1967 | Thauer | 123/90.67 |
| 3,521,608 | 7/1970 | Scheibe | 123/90.58 |
| 3,658,038 | 4/1972 | Bergmann | 123/90.55 |
| 3,704,696 | 12/1972 | Abell, Jr. | 123/90.55 |
| 3,877,446 | 4/1975 | Morgan | 123/90.55 |
| 3,941,102 | 3/1976 | Bareham | 123/90.67 |
| 4,274,370 | 6/1981 | Kodama | 123/90.55 |

FOREIGN PATENT DOCUMENTS

| | | | |
|---|---|---|---|
| 1246086 | 10/1960 | France | 123/90.65 |

*Primary Examiner*—Craig R. Feinberg
*Assistant Examiner*—W. R. Wolfe
*Attorney, Agent, or Firm*—William Nitkin

[57] ABSTRACT

A device positioned between the valve stem and cam rocker arm of an internal combustion engine having a lower valve spring retainer base and upper cap member with adjustment means associated therewith.

11 Claims, 2 Drawing Figures

POPPET VALVE SPRING RETAINER WITH INTEGRAL HYDRAULIC TAPPET

This application is a continuation of my previously filed application for a Poppet Valve Spring Retainer with Integral Hydraulic Tappet, Ser. No. 356,782, filed 03/10/82, now abandoned which application is a divisional application of my previously filed application for Poppet Valve Spring Retainer with Integral Mechanical Adjustable Tappet, Ser. No. 055,951 filed 07/09/79 which is now U.S. Pat. No. 4,321,894 issued on 03/30/82.

BACKGROUND OF THE INVENTION

1. Field of the Invention

The device of this invention resides in the area of valve adjustment means for internal combustion engines having overhead cams or rocker arms and more particularly relates to a valve spring retainer including hydraulic means for adjustment of the gap between the cam shaft and/or rocker arm and valve stem.

2. History of the Prior Art

In typical overhead cam engines the valves are operated by a rocker arm pushing on the valve stem or cam shaft pushing on bucket tappets. The rocker arm is usually actuated by a cam located in association therewith. In order to provide for the thermal expansion of the valve stem due to the heat created by the fuel combustion within the engine, gaps are usually provided between the valve stem and rocker arm. Adjustment means are provided to change this gap. Although such changes are made relatively simple by hydraulic valve lifters, in many instances there is a penalty paid in increased weight as well as decreased efficiency and reliability of the hydraulic lifter.

SUMMARY OF THE INVENTION

It is an object of this invention to provide an hydraulic lifter that would have application to both overhead cams and rocker arms thus standardizing the lifter structure.

It is an object of this invention to provide a simplified light-weight hydraulic lifter for the adjustment of the gap between a valve stem and rocker arm which is significantly less bulky than the hydraulic lifters of the prior art.

It is a further object that the valve spring's resistance to compression not be transferred directly to the top of the valve stem as presently done in the prior art.

The device of the present invention is comprised of a valve spring retainer base which is adapted to fit over the valve spring and has an bore through a central portion thereof for receipt of the valve stem, and lip means for the engagement of an outer and inner valve spring if such is used in the engine. A cap member is also provided adapted to be engaged into the valve spring retainer base.

Since no adjustments are needed in hydraulic lifters as are needed in mechanical lifters, no adjustably rotating threaded parts are needed between the cap member and the valve spring retainer base. A chamber is provided within the cap member which, when positioned within the valve spring retainer base, is held in position by a semicircular circlip which fits within a groove provided in the upper outer portion of the valve spring retainer base. An hydraulic plunger is positioned above a valve stem seal member and has provided therebetween a preloaded spring and ball combination for the capture of hydraulic fluid therein upon the downward thrust of the cam or the rocker arm. The plunger may be hollowed in its upper portion and have an aperture in its bottom aligned with the ball. The ball operates as an hydraulic valve for the plunger, the plunger being just above the ball, riding in the bore just above the pressure chamber. When the cap member is depressed, it moves the plunger inward toward the center of its chamber, thereby compressing oil within the pressure chamber which action provides the means for transferring the movement of the cap member to the valve spring retainer base due to the minimal compressibility of the oil therein. Upon this increase of pressure on the device of this invention, some oil will leak backwards out of the pressure chamber formed by the plunger and corresponding hollow in the valve spring retainer past the wall of the plunger. Oil flow is controlled by the ball which closes off the oil return to the reservoir under pressure while at times when there is no force thereupon, the hole allows oil to enter the pressure chamber beneath the ball. This design has advantages over the current art which incorporates an hydraulic lifter within a separate housing bored into the top of the cylinder head. This invention is held in position by the key on the valve stem and the pressure of the valve spring upwards against the valve spring retainer base. This design simplifies substantially the construction of hydraulic lifters and lessens significantly their weight. A valve stem bushing acts as a seal member in this embodiment and prevents the escape of oil fluid from the pressure chamber down along the valve stem. In some embodiments the valve stem seal member can be threaded into its position to prevent its movement out of its seat or sealed in position by an O-ring or an inserted cup. In this embodiment a hole can be provided within the cap member periphery and/or the valve spring retainer base in the midsection which would allow oil to enter therein and which would lessen the noise from resonance and act as an additional reservoir of oil from which the pressure chamber would draw for its proper operation. It should be noted that in this embodiment this is an additional reservoir if the motor should run low on oil, oil would still be provided within the pressure chamber due to its being trapped between the valve spring retainer base and the cap member.

An alternate embodiment of this invention utilizes a hardened steel upper cap member with a lower cap member made of lightweight material having a reservoir defined therein. Below the reservoir is a hardened steel cup member with an aperture defined therein. No seal member is used, but a second hardened steel cup member is placed in the valve spring retainer base and contains a hollow piston member. Within the upwardly facing hollow is the spring cap and ball which control entry of fluid from the reservoir.

DESCRIPTION OF THE PREFERRED EMBODIMENT(S)

Figure 1:
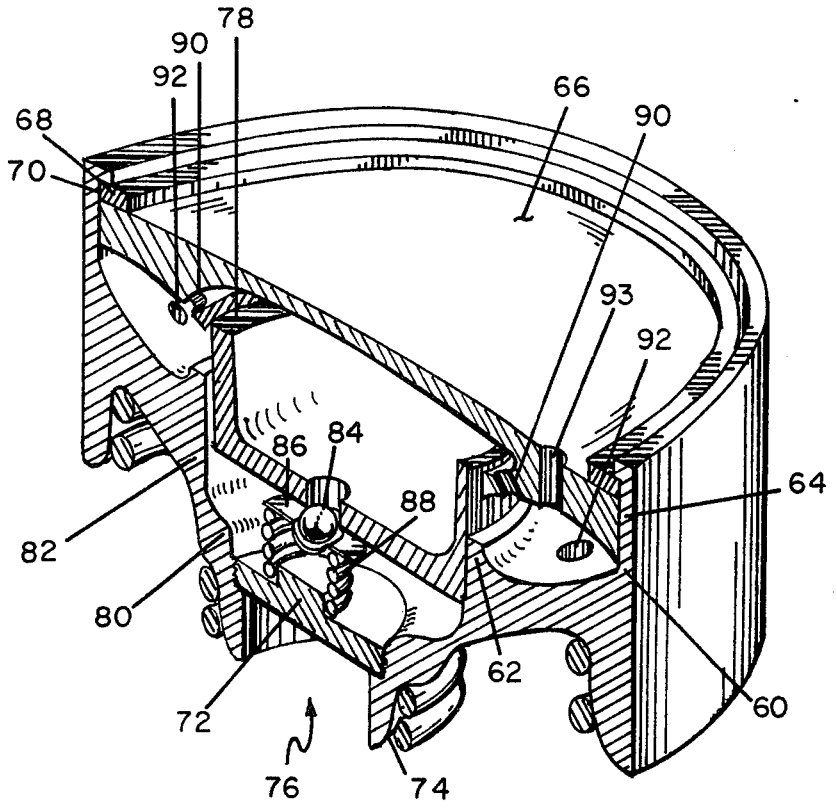
FIG. 1 is a perspective cross-sectional view of the device of this invention utilizing hydraulic lifters.

Seen in FIG. 1 is valve spring retainer base 60 with a central portion 62 and an outer portion 64. Retainer cap 66 is positioned within the valve spring retainer base and is held in place by retainer circlip 68 which fits within groove 70 within the valve spring retainer base 60. In a first embodiment a valve stem seal member 72 is located at position 74 above the valve stem receipt bore 76 above which is positioned plunger 78 which rides within pressure chamber 80 formed by projections 82 extending from valve spring retainer base 60. Below the plunger is located ball member 84 and cup 86 with spring member 88 positioned therebelow. At least one aperture 90 can be provided to allow for the entrance of oil into reservoir 81 for the hydraulic action as described above and one or more apertures 92 may be positioned within the valve spring retainer base 60 or such as 93 in cap 66 to allow for the entrance of oil therein.

Figure 2:
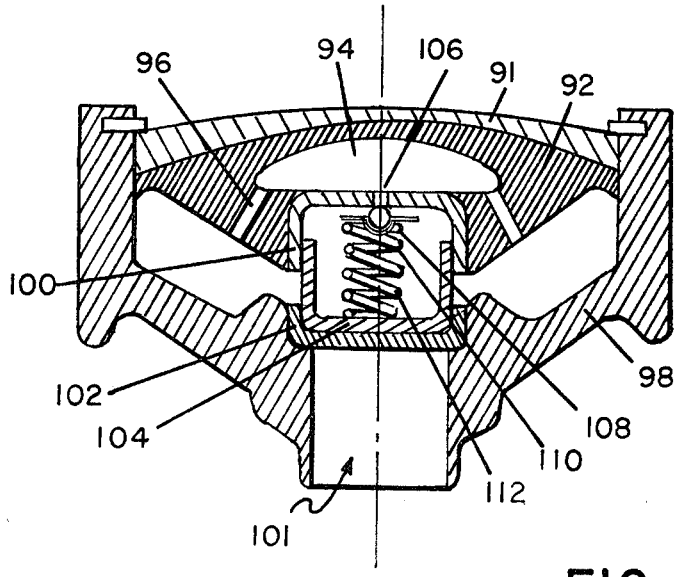
FIG. 2 is an alternate embodiment of the invention.

Illustrated in FIG. 2 is the second embodiment of this invention utilizing hardened cap 91 above lower cap 92 which has a reservoir 94 defined therein with oil entrance aperture 96 to allow oil into the reservoir. No seal member is used and this embodiment has an upper hardened steel cap 100 with an aperture defined therein positioned below the reservoir and a lower hardened bushing/seal member 102 positioned above the valve stem receipt bore 101. Within cap 102 is hollow plunger 104. Within the upward-facing hollow portion is ball 108 aligned with the aperture in the upper cap 100. Below ball 108 is cup 110 and spring 112 which extends to the inside hollow of plunger 104.

It should be noted that the valve spring retainer base and seal member can be constructed of aluminum or other lightweight material and the cap member may be made of the same material or of a harder steel-like material as mentioned above to resist wear.

It should be further noted that there are many advantages to the utilization of the valve spring retainers of this invention besides their being compact and lighter in weight than the structures that accomplish similar functions in the prior art.

In the situation where the seal member is of a predetermined strength, the valve stem retainer of this invention will advantageously provide a place of movement by its deformation when struck by the valve stem in situations where the engine is over-revved and the valve head is hit by the piston. This destruction or deformation of the seal member dissipates the destructive force, minimizing damage to the valve so that repairs may be made easily to the device of this invention without having to pull the head off the engine to reach a damaged valve.

Although the present invention has been described with reference to particular embodiments, it will be apparent to those skilled in the art that variations and modifications can be substituted therefor without departing from the principles and spirit of the invention.

I claim:

1. In an apparatus including a valve stem having a valve spring associated therewith and structure operating the valve stem within an internal combustion engine, comprising:

hydraulic lifting means for the adjustment of the thermal expansion gap between the valve stem and the operating means and being disposed between the valve stem and the operating structure and having a valve spring retaining means integrally formed therewith for retaining the valve spring in association with the valve stem, the integrally formed means comprising a body member having an open end nearmost the operating structure, side walls and a bottom wall having a valve stem receipt aperture defined in said bottom wall, the valve stem being received within the valve stem receipt aperture;

cap means disposed within the open end of the body member for closing said open end;

means for retaining the cap means in the open end of the body member; and, hydraulic plunger means disposed adjacent the cap means and internally of the body member for inward movement on depression of the cap means by the operating structure, thereby compressing fluid held within an hydraulic fluid reservoir defined by the plunger means and the cap means and transferring the movement of the cap means to the body member and through the body member to the valve stem.

2. In the apparatus of claim 1 and further comprising seal means disposed adjacent the hydraulic plunger means and partially defining an hydraulic fluid pressure chamber therebetween and being interposed therein for closing the hydraulic fluid pressure chamber and capturing hydraulic fluid therein to create fluid pressure on movement of the hydraulic plunger means toward the seal means, the movement of the cap means being transferred through the hydraulic fluid to the body member and thus to the valve stem.

3. In combination, apparatus for the adjustment of the thermal expansion gap between a valve stem having a valve spring associated therewith and structure operating the valve stem within an internal combustion engine, comprising:

a valve spring retainer member having an open end, side walls, and a bottom wall having a valve stem receipt aperture defined therein, the aperture receiving the valve stem therein;

a cap member disposed within the open end of the valve spring retainer member and acting to close said open end of the valve spring retainer member;

a plunger member disposed adjacent the cap member and internally of the body member and being moved inwardly on depression of the cap member by the operating structure; and, a seal member disposed adjacent the plunger member and defining a hydraulic fluid pressure chamber therebetween, the hydraulic fluid pressure chamber communicating with the valve stem receipt aperture, the hydraulic fluid pressure chamber having hydraulic fluid held therein which is compressed on inward movement of the plunger member to transfer movement of the cap member through the plunger member to the valve spring retainer member and through the valve spring retainer member to the valve stem.

4. In the combination of claim 3 wherein the seal member is adapted to be removable from the valve spring retainer member.

5. In the combination of claim 3 and further comprising:

lip means on said valve spring retainer member for the lateral retention of said valve spring; and, hydraulic pressure means disposed in said hydraulic pressure chamber for adjustment of the relation of said cap member to said seal member to accommodate thermal expansion.

6. In the combination of claim 3 and further comprising:

a clip retaining said cap member within an upper portion of said valve spring retainer member;

said cap member including an upper portion constructed of a hardened steel-like material and a lower portion of lightweight aluminum-like material and further having defined therein a reservoir with access apertures defined in said cap to allow entry of fluid into said reservoir, said cap member being positioned above said valve stem receipt bore, said plunger member being located within the lower portion of said cap member and forming a hollow inverted cup and having an aperture defined therein;

a ball member positioned in alignment below said aperture and said plunger member;

a cup member positioned below said ball member; and, a spring member positioned between said cup member and extending into a hollow portion of said plunger member, the hollow plunger member forming the seat of said spring member above said seal member.

7. In the combination of claim 3 and further comprising an hydraulic fluid reservoir defined by the plunger and the cap member and being adapted to supply hydraulic fluid to said hydraulic fluid pressure chamber.

8. In the combination of claim 7 and further comprising a clip retaining said cap member within an upper portion of said valve spring retainer member, a second reservoir defined between said cap member and said valve spring retainer, the hydraulic fluid pressure chamber being located above the seal member, the plunger member having a hollow area defined in the upper portion thereof and positioned within said hydraulic fluid pressure chamber, the hollow area forming said second reservoir, said plunger member having an aperture defined therein below said hollow area, a ball member located below said aperture and said plunger member, a cup member located below said ball member, and a spring member positioned between said cup member and said seal member.

9. In the combination of claim 7 wherein the hydraulic fluid reservoir is located within the plunger member and the valve spring retainer member further includes a secondary fluid reservoir interconnected to said hydraulic fluid reservoir by at least one aperture defined in the cap member.

10. In the combination of claim 9 wherein the internal combustion engine has a lubricating system and a fluid therein wherein said secondary fluid reservoir has defined therein an aperture for the entry thereinto of fluid under pressure from the lubricating system, the cap member having defined therein at least one aperture allowing entry of said fluid from said lubricating system into said secondary fluid reservoir, said fluid then being supplied into said hydraulic fluid reservoir through said aperture interconnecting said secondary reservoir and said hydraulic fluid reservoir by means of feeding of pressurized fluid.

11. In the combination of claim 10 wherein said cap member has defined therein at least one aperture allowing passage of lubricating fluid from the internal combustion engine out of either the hydraulic fluid reservoir or the secondary fluid reservoir for the purpose of lubricating upper surfaces of the cap member.

* * * * *